US010987726B2

(12) United States Patent
Liu et al.

(10) Patent No.: US 10,987,726 B2
(45) Date of Patent: Apr. 27, 2021

(54) WHEEL HUB MOLDING AND CASTING DIE AND PREPARATION PROCESS THEREOF

(71) Applicant: CITIC Dicastal Co., Ltd., Qinhuangdao (CN)

(72) Inventors: Libo Liu, Qinhuangdao (CN); Yudong He, Qinhuangdao (CN)

(73) Assignee: CITIC Dicastal Co., Ltd., Qinhuangdao (CN)

( * ) Notice: Subject to any disclaimer, the term of this patent is extended or adjusted under 35 U.S.C. 154(b) by 0 days.

(21) Appl. No.: 16/695,130

(22) Filed: Nov. 25, 2019

(65) Prior Publication Data

US 2020/0331056 A1 Oct. 22, 2020

(30) Foreign Application Priority Data

Apr. 22, 2019 (CN) ..... 201910325229.5

(51) Int. Cl.

| | |
|---|---|
| ***B22C 9/06*** | (2006.01) |
| ***B22C 9/28*** | (2006.01) |
| ***B22D 25/02*** | (2006.01) |
| ***B22D 29/00*** | (2006.01) |

(52) U.S. Cl.

CPC ..... *B22C 9/062* (2013.01); *B22C 9/28* (2013.01); *B22D 25/02* (2013.01); *B22D 29/00* (2013.01)

(58) Field of Classification Search

CPC .. B22C 9/06; B22C 9/28; B22C 9/062; B22D 25/02; B22D 29/00; B22D 15/005; B22D 18/04

USPC ..... 164/137, 339, 341, 342, 344, 131

See application file for complete search history.

(56) References Cited

U.S. PATENT DOCUMENTS 8,162,029 B2 * 4/2012 Ha ..... B21K 1/38 164/76.1

* cited by examiner

*Primary Examiner* — Kevin P Kerns

(74) *Attorney, Agent, or Firm* — IPro, PLLC; Qian Gu

(57) ABSTRACT

A wheel hub molding and casting die includes: a casting die shell, a supporting bottom plate, a limiting bottom plate, a lifting module, a module supporting plate, a lower die, an upper die and removable plates. The supporting bottom plate is mounted on the lower surface of the casting die shell. The limiting bottom plate is arranged below the supporting bottom plate. The module supporting plate is movably arranged in a molding cavity. The lifting module is connected between the bottom of the molding cavity and the module supporting plate. The lower die and the upper die are closed to form a pouring cavity. Annular slots are formed in the outer side wall of the upper die. Removable plate slots are formed in the upper surface of the casting die shell.

10 Claims, 6 Drawing Sheets

WHEEL HUB MOLDING AND CASTING DIE AND PREPARATION PROCESS THEREOF

FIELD

The present disclosure relates to the technical field of casting dies, and more particularly relates to a wheel hub molding and casting die and a preparation process thereof.

BACKGROUND

A wheel hub molding and casting die is a die for manufacturing a wheel hub. The wheel hub molding and casting die generally uses a pouring form, so as to facilitate pouring according to an actual shape requirement of a wheel hub. Since the wheel hub is an important part of an automobile tire, a wheel hub blank has great influence on the quality of the wheel hub. In a use process of an existing wheel hub molding and casting die, it is relatively inconvenient to open the die, so that after a pouring procedure and a cooling procedure are performed, the surface of a molded wheel hub is very easy to scrape and a lot of time would be spent in a taking out procedure of the molded wheel hub.

Therefore, there is a need for a wheel hub molding and casting die and a preparation process thereof to solve or at least relieve the defects in the prior art.

SUMMARY

The technical problem to be solved in the present disclosure is how to ensure that a die does not scrape a molded wheel hub when being taken down from the molded wheel hub and facilitate the taking out of the die.

The technical solution adopted by the present disclosure is as follows.

The first aspect of the present disclosure provides a wheel hub molding and casting die. The wheel hub molding and casting die includes: a casting die shell, a supporting bottom plate, a limiting bottom plate, a lifting module, a module supporting plate, a lower die, an upper die and removable plates.

The supporting bottom plate is tightly mounted on the lower surface of the casting die shell.

The limiting bottom plate is arranged below the supporting bottom plate, and is used to support and limit the casting die shell and the supporting bottom plate.

A molding cavity is formed in the middle part of the upper surface of the casting die shell. The lower end of the lifting module is mounted at the middle position of the bottom of the molding cavity. The upper end of the lifting module is mounted at the middle part of the lower surface of the module supporting plate. The module supporting plate is movably arranged in the molding cavity. The lifting module is used to push the module supporting plate to move.

Both the lower die and the upper die are of detachable structures. The lower die is mounted at the middle part of the upper surface of the module supporting plate. The upper die is arranged on the outer side of the lower die in a sleeving manner. The outer wall of the lower die and the inner wall of the upper die are closed to form a pouring cavity. A plurality of pouring holes passing through the pouring cavity are formed in the upper surface of the upper die. Annular slots are formed in the outer side wall of the upper die.

A plurality of removable plate slots communicating with the molding cavity are formed in the upper surface of the casting die shell. The removable plates are arranged on the removable plate slots in a movably limited manner. The removable plates are fitted with the annular slots, and are used to remove and take out the upper die after the pouring is completed.

Preferably, the casting die shell is of a rectangular shell-like structure. The molding cavity is of a circular cavity structure. The module supporting plate is of a circular plate-type structure fitted with the molding cavity.

Preferably, a limiting column is arranged in the center of the upper surface of the module supporting plate. A limiting slot fitted with the limiting column is formed in the middle part of the lower surface of the lower die. The lower die is clamped at the middle part of the upper surface of the module supporting plate through the matching between the limiting column and the limiting slot.

Preferably, the upper die is of a cylindrical shell-like structure. The plurality of pouring holes are uniformly distributed relative to a circumferential direction of the upper surface of the upper die.

Preferably, the lower surface of the lower die and the upper surface of the module supporting plate are hermetically fitted, and the lower surface of the upper die and the upper surface of the module supporting plate are hermetically fitted.

Preferably, moving slots are formed in two side walls of the removable plate slots, and each of the moving slots includes a first branch slot, a second branch slot and a third branch slot which communicate in sequence.

The second branch slots are straight slots in the same direction as the removable plate slots. The first branch slots and the third branch slots are separately arranged at two ends of the second branch slots. The first branch slots and the third branch slots are both fixed clamping slots that are slantways downward relative to the second branch slots.

Mounting through holes are formed in the middle parts of the side walls of the removable plates. Supporting shafts movably passing through the side walls of the removable plates are arranged at the middle parts of the side walls of the removable plates through the mounting through holes. The end parts of the supporting shafts are fitted with the moving slots. The end parts of two ends of the supporting shafts are removably placed in the moving slots.

Preferably, the mounting through holes include first side holes, middle holes and second side holes which communicate in sequence. The apertures of the first side holes and the second side holes are the same, and are less than the apertures of the middle holes.

Each of the supporting shafts includes two struts and a connection spring. The struts are of "T"-shaped cylinder structures. The two struts are separately arranged on two sides of the mounting through hole. The sections, having a relatively large diameter, of the struts are clamped in the middle holes. The connection spring is connected between the end parts of the sections, having a relatively large diameter, of the two struts.

Preferably, locating tubes are fixed at the periphery of the upper surface of the limiting bottom plate. The locating tubes are of circular barrel-shaped structures with openings in the tops. Locating columns fitted with the locating tubes are arranged on the lower surface of the supporting bottom plate. The limiting bottom plate supports and limits the casting die shell and the supporting bottom plate through the movable matching between the locating tubes and the locating columns.

Preferably, the lifting module is a cylinder. The fixed end of the cylinder is mounted at the middle position of the bottom of the molding cavity. The movable end of the cylinder is mounted at the middle part of the lower surface of the module supporting plate.

The second aspect of the present disclosure provides a preparation process of the wheel hub molding and casting die as mentioned above. The preparation process includes:

1) preparatory work before pouring: fixedly mounting a lower die and an upper die on a module supporting plate, driving the module supporting plate and the lower die and the upper die which are fixed thereon to be retracted at the bottom of the molding cavity by using a lifting module, and moving and limiting removable plates at the outer ends of removable plate slots to ensure that the end parts of the removable plates do not extend into the molding cavity;

2) pouring: uniformly pouring metal liquid required by prefabrication of a wheel hub into a pouring cavity through pouring holes of the upper die;

3) normal-temperature cooling: after the pouring is completed for 20 to 30 min, driving the module supporting plate and the lower die and the upper die which are fixed thereon to extend out of the upper end of the molding cavity by using the lifting module, and standing under a normal-temperature condition for 10 to 12 h for cooling; and 4) taking out of a molded wheel hub: after the normal-temperature cooling is completed, adjusting the height of the module supporting plate by using the lifting module till annular slots in the outer side wall of the upper die are aligned with the removable plates, moving the removable plates to enable the end parts of the removable plates to be clamped in the annular slots, cyclically levering the ends, away from the upper die, of the removable plates, removing and taking out the upper die, and then taking down the molded wheel hub from the lower die.

According to one or more implementations of the present disclosure, the following beneficial effects can be achieved:

The wheel hub molding and casting die and the preparation process thereof of the present disclosure can conveniently and quickly take down the upper die from the molded wheel hub, so that it is ensured that the upper die would not scrape the molded wheel hub when being taken down from the molded wheel hub. The wheel hub molding and casting die is simple in structure and convenient to operate, and effectively improves the quality of the molded wheel hub, so cracks are not liable to form on the wheel hub.

BRIEF DESCRIPTION OF THE DRAWINGS

The technical and industrial meanings of the features, advantages and exemplary implementations of the present disclosure will be described below with reference to accompanying drawings. In the drawings, the same numerals refer to same elements.

In the drawings.

Figure 1:
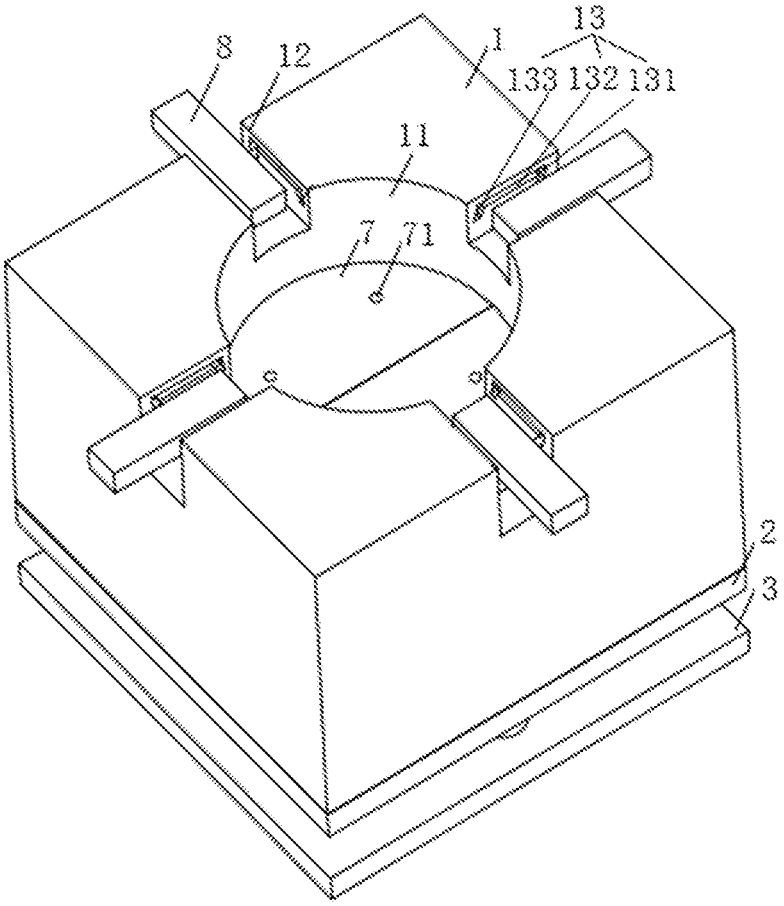
FIG. 1 is a three-dimensional structural schematic diagram of a wheel hub molding and casting die according to one embodiment of the present disclosure.

1: casting die shell; 11: molding cavity; 12: removable plate slot; 13: moving slot: 131: first branch slot; 132: second branch slot; 133: third branch slot;

2: supporting bottom plate; 21: locating column;

3: limiting bottom plate; 31: locating tube;

4: lifting module;

5: module supporting plate; 51: limiting column;

6: lower die; 61: limiting slot;

7: upper die; 71: pouring hole; 72: annular slot;

8: removable plate; 81: mounting through hole; 82: supporting shaft; 821: strut; 822: connection spring; and

9: pouring cavity.

DETAILED DESCRIPTION OF THE EMBODIMENTS

The exemplary implementations of the present disclosure are described below in detail with reference to the drawings. The descriptions of the exemplary implementations are merely illustrative, and shall in no way limit the present disclosure and its application or usage. Furthermore, the sizes and proportions of all the components in the drawings are also merely illustrative, and do not really correspond to actual products.

The core of the present disclosure is to provide a wheel hub molding and casting die, which can ensure that the die would not scrape a molded wheel hub when being taken down from the molded wheel hub and facilitate the taking out of the die. The other core of the present disclosure is to provide a preparation process of a wheel hub molding and casting die, which can ensure the correct use of the wheel hub molding and casting die and improve the quality of the molded wheel hub.

Figure 2:
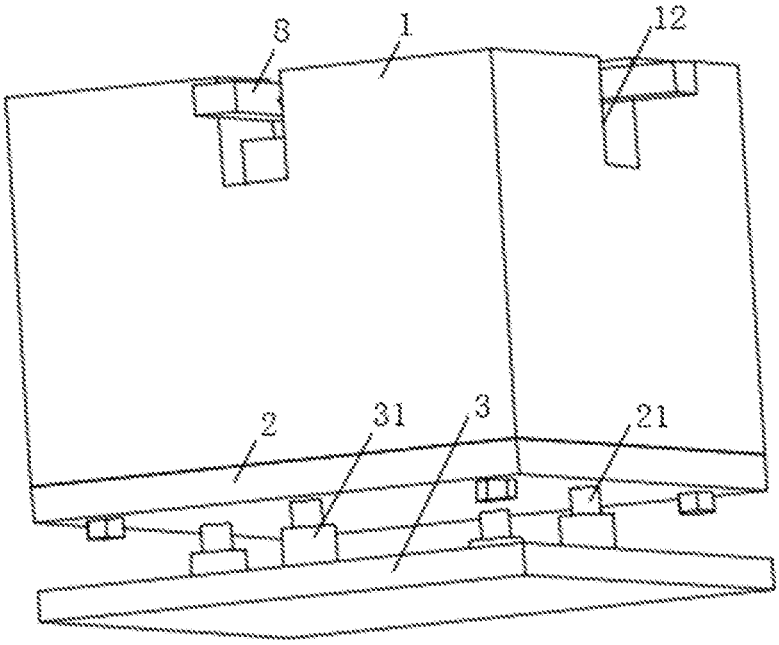
FIG. 2 is a three-dimensional structural schematic diagram of the wheel hub molding and casting die as shown in FIG. 1 from another visual angle.
Figure 3:
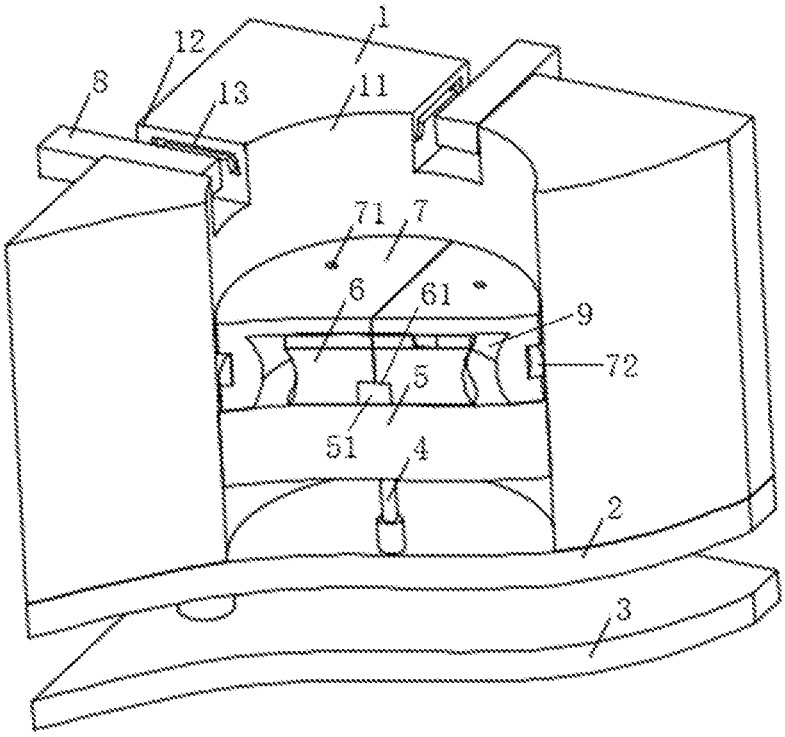
FIG. 3 is a cross-sectional view of the wheel hub molding and casting die as shown in FIG. 1.
Figure 4:
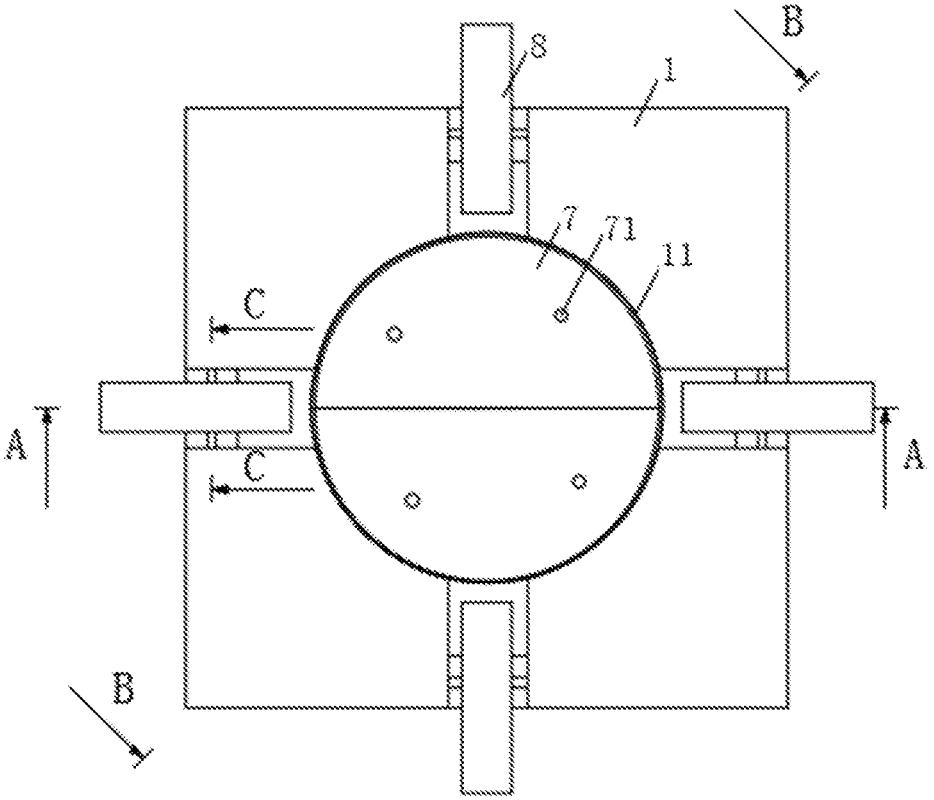
FIG. 4 is a top view of the wheel hub molding and casting die as shown in FIG. 1.
Figure 5:
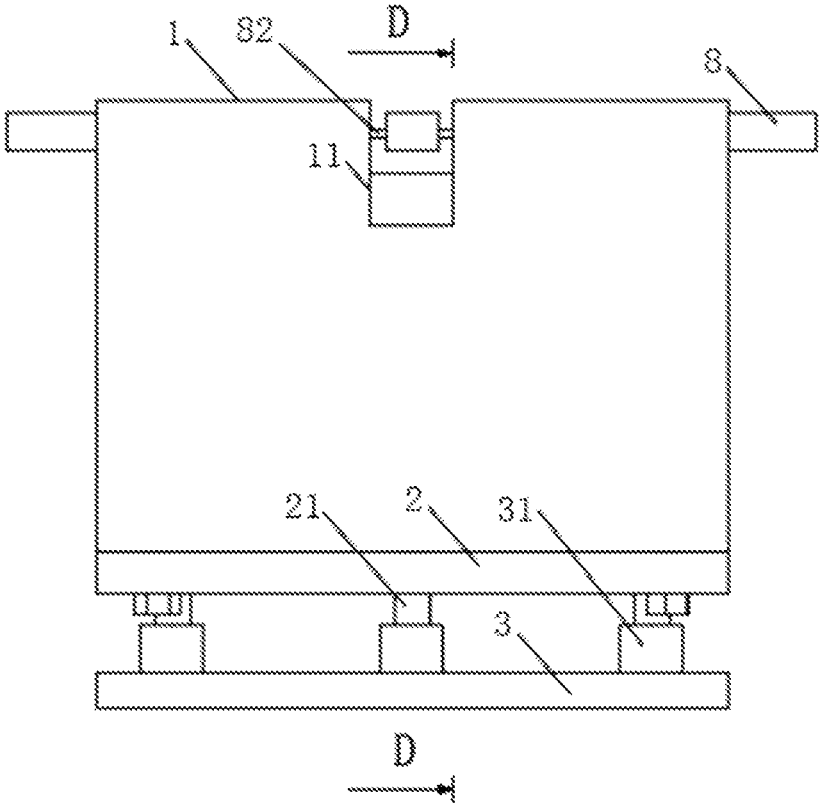
FIG. 5 is a side view of the wheel hub molding and casting die as shown in FIG. 1.
Figure 6:
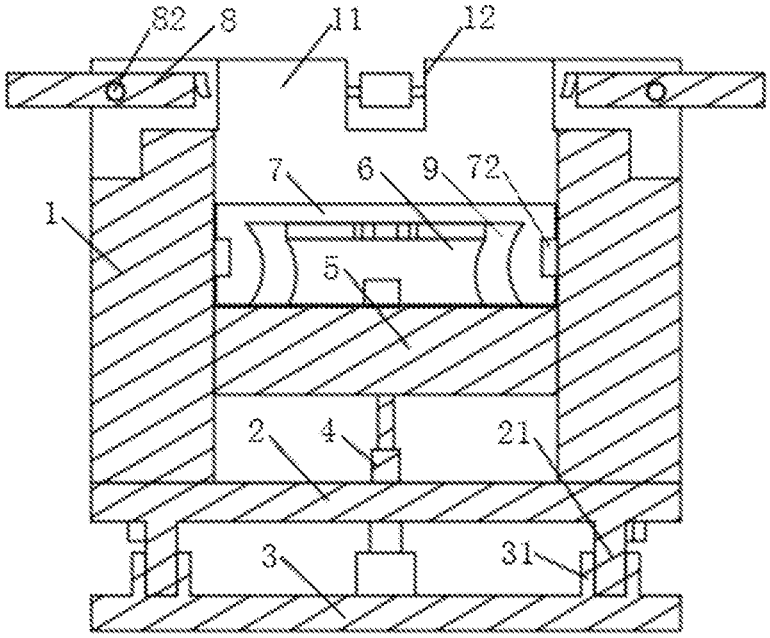
FIG. 6 is a sectional view of a portion A-A in FIG. 4.
Figure 7:
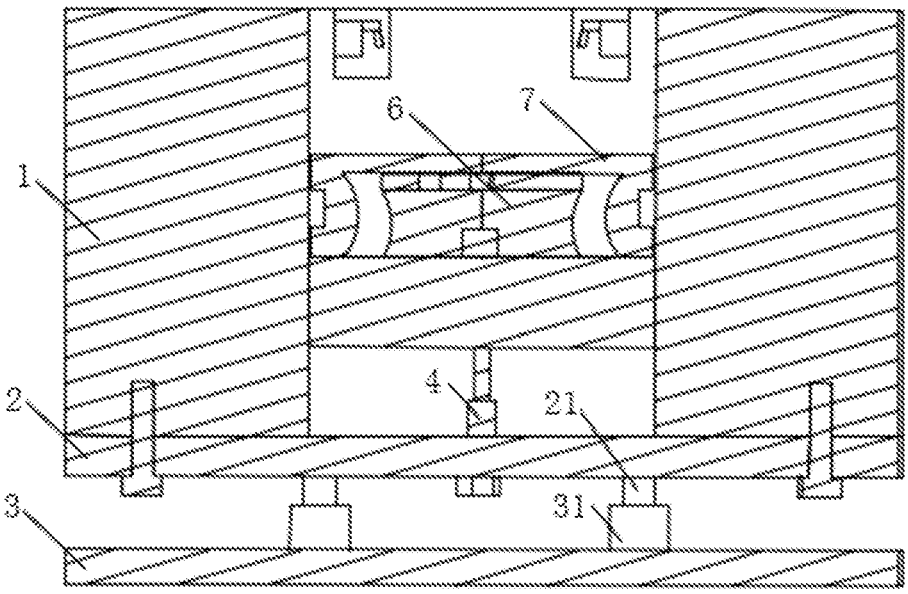
FIG. 7 is a sectional view of a portion B-B in FIG. 4.
Figure 8:
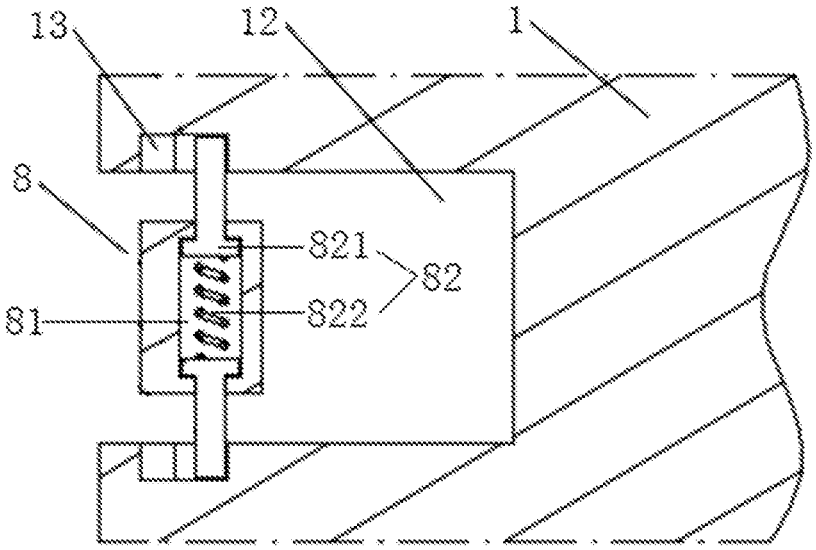
FIG. 8 is a sectional view of a portion C-C in FIG. 4.
Figure 9:
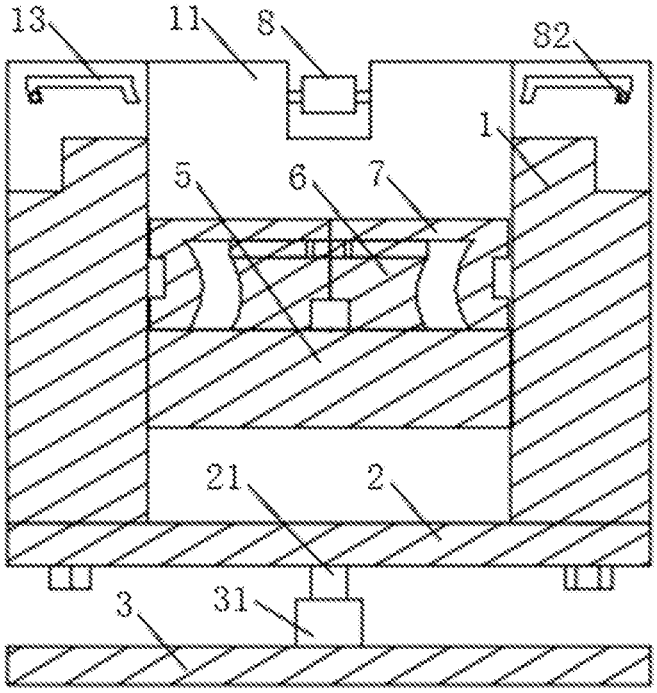
FIG. 9 is a sectional view of a portion D-D in FIG. 5.

Referring to FIGS. 1 to 9, on the first aspect, the embodiment of the present disclosure provides a wheel hub molding and casting die. The wheel hub molding and casting die includes: a casting die shell 1, a supporting bottom plate 2, a limiting bottom plate 3, a lifting module 4, a module supporting plate 5, a lower die 6, an upper die 7 and removable plates 8. The supporting bottom plate 2 is tightly mounted on the lower surface of the casting die shell 1. The limiting bottom plate 3 is arranged below the supporting bottom plate 2, and is used to support and limit the casting die shell 1 and the supporting bottom plate 2. A molding cavity 11 is formed in the middle part of the upper surface of the casting die shell 1. The lower end of the lifting module 4 is mounted at the middle position of the bottom of the molding cavity 11. The upper end of the lifting module 4 is mounted at the middle part of the lower surface of the module supporting plate 5. The module supporting plate 5 is movably arranged in the molding cavity 11. The lifting module 4 is used to push the module supporting plate 5 to move. Both the lower die 6 and the upper die 7 are of detachable structures. The lower die 6 is mounted at the middle part of the upper surface of the module supporting plate 5. The upper die 7 is arranged on the outer side of the lower die 6 in a sleeving manner. The outer wall of the lower die 6 and the inner wall of the upper die 7 are closed to form a pouring cavity 9. A plurality of pouring holes 71 passing through the pouring cavity 9 are formed in the upper surface of the upper die 7. Annular slots 72 are formed in the outer side wall of the upper die 7. A plurality of removable plate slots 12 communicating with the molding cavity 11 are formed in the upper surface of the casting die shell 1. The removable plates 8 are arranged on the removable plate slots 12 in a movably limited manner. The removable plates 8 are fitted with the annular slots 72, and are used to remove and take out the upper die 7 after the pouring is completed.

The working principle of the wheel hub molding and casting die provided by the embodiment of the present disclosure is described below.

During use, the module supporting plate 5 is firstly pushed out of the upper end of the molding cavity 11 by using the lifting module 4, and the lower die 6 and the upper die 7 are fixedly mounted on the module supporting plate 5. Then, the module supporting plate 5 and the lower die 6 and the upper die 7 which are fixed thereon are driven to be retracted at the bottom of the molding cavity 11 by using the lifting module 4. The removable plates 8 are moved and limited at the outer ends of the removable plate slots 12 to ensure that the end parts of the removable plates 8 do not extend into the molding cavity 11. Metal liquid required by prefabrication of a wheel hub is uniformly poured into the pouring cavity 9 formed by the upper die 7 and the lower die 6 through the pouring holes 71 of the upper die 7. After the pouring is completed for 20 to 30 min, the module supporting plate 5 and the lower die 6 and the upper die 7 which are fixed thereon are driven to extend out of the upper end of the molding cavity 11 by using the lifting module 4, and stand under a normal-temperature condition for 10 to 12 h for cooling. After the normal-temperature cooling is completed, the height of the module supporting plate 5 is adjusted by using the lifting module 4 to adjust the position of the upper die 7 till the annular slots 72 in the outer side wall of the upper die 7 are aligned with the removable plates 8. The removable plates 8 are moved to enable one end of each of the removable plates 8 to get close to the upper die 7 till the end part of one end of the removable plate 8 is clamped in the annular slot 72. Then, the ends, away from the upper die 7, of the removable plates 8 are cyclically levered to remove and take out the upper die 7. The molded wheel hub is taken down from the lower die 6, and the lower die 6 is taken down from the module supporting plate 5. Therefore, the preparation of the molded wheel hub is completed.

It can be seen that according to the wheel hub molding and casting die provided by the embodiment of the present disclosure, by arranging the removable plate slots 12 and the removable plates 8 on the casting die shell 1 and setting the upper die 7 to be a detachable structure, after the pouring and cooling are completed, the removable plates 8 are used to cyclically lever the upper die 7, so that the upper die 7 may be conveniently and quickly taken down from the molded wheel hub to ensure that the upper die 7 would not scrape the molded wheel hub when being taken down from the molded wheel hub. The wheel hub molding and casting die is simple in structure and convenient to operate, and effectively improves the quality of the molded wheel hub.

The casting die shell 1 may be of a rectangular shell-like structure. The molding cavity 11 may be of a circular cavity structure. The module supporting plate 5 is of a circular plate-type structure fitted with the molding cavity 11, which is advantageous for the machining and matching of the molding cavity 11 and the module supporting plate 5.

As mentioned above, the lower die 6 is mounted at the middle part of the upper surface of the module supporting plate 5. In order to facilitate the fixed locating of the lower die 6, a matching mode for the module supporting plate 5 and the lower die 6 is specifically provided below: a limiting column 51 is arranged in the center of the upper surface of the module supporting plate 5; a limiting slot 61 fitted with the limiting column 51 is formed in the middle part of the lower surface of the lower die 6; and the lower die 6 is clamped at the middle part of the upper surface of the module supporting plate 5 through the matching between the limiting column 51 and the limiting slot 61.

Further, in order to facilitate the pouring and ensure relatively uniform dispersion of the metal liquid during pouring to improve the quality of the poured molded wheel hub, in the embodiment of the present disclosure, the upper die 7 may be of a cylindrical shell-like structure, and the outer diameter of the upper die 7 is fitted with the inner diameter of the molding cavity 11. The plurality of pouring holes 71 are uniformly distributed relative to a circumferential direction of the upper surface of the upper die 7. Preferably, there may be four pouring holes 71. The four pouring holes 71 are uniformly distributed along the circumferential direction of the upper surface of the upper die 7.

In the embodiment of the present disclosure, in order to facilitate the removal and installation of the upper die 7 and the lower die 6, both the upper die 7 and the lower die 6 are of detachable structures. Preferably, the upper die 7 may include two mutually symmetrically fitted half upper dies. The two half upper dies are detachably fixedly connected into a whole. Similarly, the lower die 6 may include two mutually symmetrically fitted half lower dies. The two half lower dies are detachably fixedly connected into a whole.

In the embodiment of the present disclosure, in order to avoid the metal liquid from flowing out of the pouring cavity 9 and affecting the pouring quality, the lower surface of the lower die 6 is hermetically fitted to the upper surface of the module supporting plate 5, and the lower surface of the upper die 7 is hermetically fitted to the upper surface of the module supporting plate 5.

As mentioned above, the removable plates 8 are arranged on the removable plate slots 12 in the movably limited manner. For how to realize the movably limited arrangement of the removable plates 8 on the removable plate slots 12, the embodiment of the present disclosure provides a specific structure of the removable plate slot 12 and the removable plate 8.

Specifically, moving slots 13 are formed in two side walls of the removable plate slot 12, and each of the moving slots 13 includes a first branch slot 131, a second branch slot 132 and a third branch slot 133 which communicate in sequence.

The second branch slot 132 is a straight slot in the same direction as the removable plate slot 12. The first branch slot 131 and the third branch slot 133 are separately arranged at two ends of the second branch slot 132. The first branch slot 131 and the third branch slot 133 are both fixed clamping slots that are slantways downward relative to the second branch slot 132.

A mounting through hole 81 is formed in the middle part of the side wall of the removable plate 8. A supporting shaft 82 movably passing through the side wall of the removable plate 8 is arranged at the middle part of the side wall of the removable plate 8 through the mounting through hole 81. The end parts of the supporting shaft 82 are fitted with the moving slots 13. The end parts of the two ends of the supporting shaft 82 are removably placed in the moving slots 13.

When the removable plates 8 need to be limited and fixed, the removable plates 8 are moved to the fixed clamping slots. The positions of the first branch slots 131, the second branch slots 132 and the third branch slots 133 are set according to the position and size of the molding cavity 11 and the positions of the annular slots 72 when the upper die 7 is fixed on the module supporting plate 5. When it is ensured that the removable plates 8 are located in the fixed clamping slots close to the molding cavity 11, the removable plates 8 are just clamped in the annular slots 72; and when the removable plates 8 are located in the fixed clamping slots away from the molding cavity 11, the removable plates 8 do not extend into the molding cavity 11. The first branch slots 131 are farther from the molding cavity than the third branch slots 133.

In order to facilitate the removal and installation of the removable plates 8, the mounting through holes 81 include first side holes, middle holes and second side holes which communicate in sequence. The apertures of the first side holes and the second side holes are the same, and are less than the apertures of the middle holes.

Each of the supporting shafts 82 includes two struts 821 and a connection spring 822. The struts 821 are of "T"-shaped cylinder structures. The two struts 821 are separately arranged on two sides of the mounting through hole 81. The sections, having a relatively large diameter, of the struts 821 are clamped in the middle holes. The connection spring 822 is connected between the end parts of the sections, having a relatively large diameter, of the two struts 821.

Further, in order to increase the clamping force between the removable plates 8 and the annular slots 72 and facilitate the cyclic levering of the removable plates 8, in the embodiment of the present disclosure, there may be four removable plate slots 12. The four removable plate slots 12 are symmetrically distributed, and are all located at the middle parts of the side edges of the casting die shell 1. The removable plate slots 12 may be of "L"-shaped structures. The slot depth of the end, away from the molding cavity 11, of each removable plate slot 12 is greater than the slot depth of the end, close to the molding cavity 11, of the removable plate slot 12.

Preferably, in the embodiment of the present disclosure, in order to achieve the supporting and limiting effects of the limiting bottom plate 3 on the casting die shell 1 and the supporting bottom plate 2, locating tubes 31 are fixed at the periphery of the upper surface of the limiting bottom plate 3. The locating tubes 31 are of circular barrel-shaped structures with openings in the tops. Locating columns 21 fitted with the locating tubes 31 are arranged on the lower surface of the supporting bottom plate 2. The limiting bottom plate 3 supports and limits the casting die shell 1 and the supporting bottom plate 2 through the movable matching between the locating tubes 31 and the locating columns 21.

The supporting bottom plate 2 may be tightly mounted on the lower surface of the casting die shell 1 in a bolting manner, so as to ensure that the upper surface of the supporting bottom plate 2 is tightly fitted to the lower surface of the casting die shell 1.

Preferably, in the embodiment of the present disclosure, the lifting module 4 may be a cylinder. The fixed end of the cylinder is mounted at the middle position of the bottom of the molding cavity 11. The movable end of the cylinder is mounted at the middle part of the lower surface of the module supporting plate 5.

On the second aspect, the embodiment of the present disclosure provides a preparation process of the wheel hub molding and casting die as mentioned above. The preparation process includes the following steps that:

1) preparatory work before pouring: a lower die 6 and an upper die 7 are fixedly mounted on a module supporting plate 5; the module supporting plate 5 and the lower die 6 and the upper die 7 which are fixed thereon are driven to be retracted at the bottom of the molding cavity 11 by using the lifting module 4; removable plates 8 are moved and limited at the outer ends of removable plate slots 12 to ensure that the end parts of the removable plates 8 do not extend into the molding cavity;

2) pouring: metal liquid required by prefabrication of a wheel hub is uniformly poured into a pouring cavity 9 through pouring holes 71 of the upper die 7;

3) normal-temperature cooling: after the pouring is completed for 20 to 30 min, the module supporting plate 5 and the lower die 6 and the upper die 7 which are fixed thereon are driven to extend out of the upper end of the molding cavity 11 by using the lifting module 4, and stand under a normal-temperature condition for 10 to 12 h for cooling; and 4) taking out of a molded wheel hub: after the normal-temperature cooling is completed, the height of the module supporting plate 5 is adjusted by using the lifting module 4 till annular slots 72 in the outer side wall of the upper die 7 are aligned with the removable plates 8; the removable plates 8 are moved to enable the end parts of the removable plates 8 to be clamped in the annular slots 72; the ends, away from the upper die 7, of the removable plates 8 are cyclically levered; and the upper die 7 is removed and taken out, and then the molded wheel hub is taken down from the lower die 6.

It can be seen that according to the preparation process of the wheel hub molding and casting die provided by the embodiment of the present disclosure, the upper die 7 may be successfully taken down from the molded wheel hub to ensure that the upper die 7 would not scrape the molded wheel hub when being taken down from the molded wheel hub, so that the wheel hub molding and casting die is simple in structure and convenient to operate, and effectively improves the quality of the molded wheel hub. Furthermore, the normal-temperature cooling includes short-time cooling in the molding cavity 11 and long-time cooling outside the molding cavity 11, so that the wheel hub molding quality is effectively improved, and cracks are not liable to form on the wheel hub.

What is claimed is:

1. A wheel hub molding and casting die, comprising: a casting die shell, a supporting bottom plate, a limiting bottom plate, a lifting module, a module supporting plate, a lower die, an upper die and removable plates, wherein the supporting bottom plate is tightly mounted on a lower surface of the casting die shell;

the limiting bottom plate is arranged below the supporting bottom plate, and is used to support and limit the casting die shell and the supporting bottom plate;

a molding cavity is formed in a middle part of an upper surface of the casting die shell; a lower end of the lifting module is mounted at a middle position of a bottom of the molding cavity; an upper end of the lifting module is mounted at a middle part of a lower surface of the module supporting plate; the module supporting plate is movably arranged in the molding cavity; and the lifting module is used to push the module supporting plate to move;

both the lower die and the upper die are of detachable structures; the lower die is mounted at a middle part of an upper surface of the module supporting plate; the upper die is arranged on an outer side of the lower die in a sleeving manner; an outer wall of the lower die and an inner wall of the upper die are closed to form a pouring cavity; a plurality of pouring holes passing through the pouring cavity are formed in an upper surface of the upper die; and annular slots are formed in an outer side wall of the upper die;

a plurality of removable plate slots communicating with the molding cavity are formed in the upper surface of the casting die shell; the removable plates are arranged on the removable plate slots in a movably limited manner; and the removable plates are fitted with the annular slots, and are used to remove the upper die after a pouring is completed.

2. The wheel hub molding and casting die according to claim 1, wherein the casting die shell is of a rectangular shell structure; the molding cavity is of a circular cavity structure; and the module supporting plate is of a circular plate structure fitted with the molding cavity.

3. The wheel hub molding and casting die according to claim 2, wherein a limiting column is arranged in a center of an upper surface of the module supporting plate; a limiting slot fitted with the limiting column is formed in a middle part of a lower surface of the lower die; and the lower die is clamped at a middle part of the upper surface of the module supporting plate through matching between the limiting column and the limiting slot.

4. The wheel hub molding and casting die according to claim 3, wherein the upper die is of a cylindrical shell structure; and the plurality of pouring holes are uniformly distributed relative to a circumferential direction of the upper surface of the upper die.

5. The wheel hub molding and casting die according to claim 4, wherein the lower surface of the lower die and the upper surface of the module supporting plate are hermetically fitted, and a lower surface of the upper die and the upper surface of the module supporting plate are hermetically fitted.

6. The wheel hub molding and casting die according to claim 1, wherein moving slots are formed in two side walls of the removable plate slots, and each of the moving slots comprises a first branch slot, a second branch slot and a third branch slot which communicate in sequence;

the second branch slots are straight slots in the same direction as the removable plate slots; the first branch slots and the third branch slots are separately arranged at two ends of the second branch slots; the first branch slots and the third branch slots are both fixed clamping slots that are slantways downward relative to the second branch slots;

mounting through holes are formed in middle parts of the side walls of the removable plates; supporting shafts movably passing through the side walls of the removable plates are arranged at the middle parts of the side walls of the removable plates through the mounting through holes; end parts of the supporting shafts are fitted with the moving slots; and end parts of two ends of the supporting shafts are removably placed in the moving slots.

7. The wheel hub molding and casting die according to claim 6, wherein the mounting through holes comprise first side holes, middle holes and second side holes which communicate in sequence, and apertures of the first side holes and the second side holes are the same, and are less than apertures of the middle holes;

each of the supporting shafts comprises two struts and a connection spring; the struts are of "T"-shaped cylinder structures respectively including sections having a larger diameter and sections having a smaller diameter; the two struts are separately arranged on two sides of the mounting through hole; the sections having larger diameter of the struts are clamped in the middle holes; and the connection spring is connected between end parts of the sections having a larger diameter of the two struts.

8. The wheel hub molding and casting die according to claim 1, wherein locating tubes are fixed at a periphery of an upper surface of the limiting bottom plate; the locating tubes are of circular barrel-shaped structures with openings in their tops; locating columns fitted with the locating tubes are arranged on a lower surface of the supporting bottom plate; and the limiting bottom plate supports and limits the casting die shell and the supporting bottom plate through movable matching between the locating tubes and the locating columns.

9. The wheel hub molding and casting die according to claim 1, wherein the lifting module is a cylinder; a fixed end of the cylinder is mounted at a middle position of a bottom of the molding cavity; and a movable end of the cylinder is mounted at a middle part of a lower surface of the module supporting plate.

10. A preparation process of the wheel hub molding and casting die according to claim 1, comprising:

1) preparatory work before pouring: fixedly mounting a lower die and an upper die on a module supporting plate, driving the module supporting plate and the lower die and the upper die which are fixed thereon to be retracted at a bottom of the molding cavity by using a lifting module, and moving and limiting removable plates at outer ends of removable plate slots to ensure that end parts of the removable plates do not extend into the molding cavity;

2) pouring: uniformly pouring metal liquid required by prefabrication of a wheel hub into a pouring cavity through pouring holes of the upper die;

3) normal-temperature cooling: after the pouring is completed for 20 to 30 min, driving the module supporting plate and the lower die and the upper die which are fixed thereon to extend out of an upper end of the molding cavity by using the lifting module, and standing under a normal-temperature condition for 10 to 12 h for cooling; and 4) taking out of a molded wheel hub: after the normal-temperature cooling is completed, adjusting a height of the module supporting plate by using the lifting module till annular slots in an outer side wall of the upper die are aligned with the removable plates, moving the removable plates to enable the end parts of the removable plates to be clamped in the annular slots, cyclically levering ends, away from the upper die, of the removable plates, removing and taking out the upper die, and then taking down the molded wheel hub from the lower die.

* * * * *